US005918785A

United States Patent [19]

Irose

[11] Patent Number: 5,918,785

[45] Date of Patent: Jul. 6, 1999

[54] CARRYING ASSEMBLY AND METHOD THEREOF

[76] Inventor: Mark Meehan Irose, 4 Castle St. #2, Great Barrington, Mass. 01230

[21] Appl. No.: 08/870,072

[22] Filed: Jun. 5, 1997

[51] Int. Cl.[6] ..... A45F 3/04

[52] U.S. Cl. ..... 224/259; 224/250; 224/651; 224/910; 224/638; 294/150; 294/157

[58] Field of Search ..... 224/153, 191, 224/578, 579, 580, 627, 642, 643, 645, 651, 250, 259, 601, 602, 603, 610, 611, 612, 613, 910; 294/138, 149, 150, 152, 157; 206/314; D3/215, 216

[56] References Cited

U.S. PATENT DOCUMENTS

| | | | |
|---|---|---|---|
| 925,986 | 6/1909 | Blackburn | 294/157 |
| 4,676,418 | 6/1987 | Lowe | 224/638 |
| 4,809,896 | 3/1989 | McColly | 224/259 |
| 4,881,684 | 11/1989 | Chinman | 224/627 |
| 4,972,981 | 11/1990 | Gex | 224/250 |
| 5,297,835 | 3/1994 | Wengler | 294/157 |
| 5,379,891 | 1/1995 | Coleman | 206/314 |
| 5,407,110 | 4/1995 | Marsh, Jr. | 224/250 |
| 5,470,119 | 11/1995 | Huf | 294/157 |
| 5,579,966 | 12/1996 | Krumweide et al. | 224/259 |

*Primary Examiner*—Gregory M. Vidovich
*Attorney, Agent, or Firm*—Christopher Horgan

[57] ABSTRACT

A harness and shoulder strap assembly to securely enclose, support, and form a carrying device for musical instrument cases. The case-engaging harness and shoulder straps are comprised of a plurality of adjustable strap loops connected by various fastenings, adjusters, releasable buckles, joiners, and fixing methods. The harness and shoulder strap assembly can safely support and carry a wide variety of size, shape, and style instruments and instrument cases.

4 Claims, 4 Drawing Sheets

CARRYING ASSEMBLY AND METHOD THEREOF

BACKGROUND

1. Field of the Invention

This invention relates to the carrying of cases, specifically the carrying of musical instruments and instrument cases by employing a harness and strap assembly to enclose and comfortably carry such an instrument and instrument cases.

2. Description of the Prior Art

Any musician, amateur or professional, must regularly transport his or her instrument through a variety of conditions and obstacles. Such travel with instruments often includes various methods of transportation and distances. Musical instruments are usually delicate and often valuable therefore requiring rigid, heavy cases to protect them while being transported. While such cases protect the instrument, they often impede travel on foot, through crowds, or for any substantial distance. Such cases are also difficult to maneuver in confined spaces. Heavy, protective cases can cause strain and tire the carrier when clutched in the hand or hanging off a shoulder for long periods of time. This is particularly problematic since most musicians delicately employ their hands and arms in order to play their instruments. Devices for transporting musical instruments more comfortably generally compromise the protective traits of rigid cases in order to be lighter and easier to transport.

One common solution is to use what is often referred to as a "gig bag" which is a light-weight, soft, pliable case. Such soft cases have many inherent disadvantages. They offer an instrument little protection from bumps and can be easily knocked or crushed. If an instrument in a soft case falls off the wearer, falls over while standing, or the wearer falls or stumbles, the instrument can easily be damaged. Such soft cases are designed and manufactured specifically to fit a certain style and type of instrument. An owner of multiple instruments must have a different soft case customized for each instrument. This considerable expense is usually in addition to the expense of a regular protective case and sacrifices the instrument's protection for ease of transport. Also a soft case cannot be used to transport a musical instrument when travel circumstances necessitate that the instrument be stacked in a cargo hold or checked on public transportation. In such circumstance a soft case would not offer the contained instrument the necessary protection to ensure its safe, undamaged transport.

SUMMARY OF THE PRESENT INVENTION

The present invention discloses a carrying assembly and method thereof for carrying an instrument or instrument case comprising: a plurality of longitudinal straps; a plurality of transverse straps connected to each of said plurality of longitudinal straps; and a plurality of shoulder strap assemblies.

The present invention discloses a carrying assembly and method thereof for carrying a rigid musical instrument case comprising: first and second longitudinal straps; first and second transverse straps connected to said first and second longitudinal straps; first and second shoulder strap assemblies attached to both the first and second longitudinal straps and the first and second transverse straps; a handle attached to the first and second longitudinal straps; a bottom strap attached to the first and second longitudinal straps; and wherein the longitudinal straps, transverse straps, and shoulder strap assemblies are adjustable and releasable through the use of a plurality of adjusters and releasable fasteners.

DETAILED DESCRIPTION OF THE PREFERRED EMBODIMENTS

Figure 1:
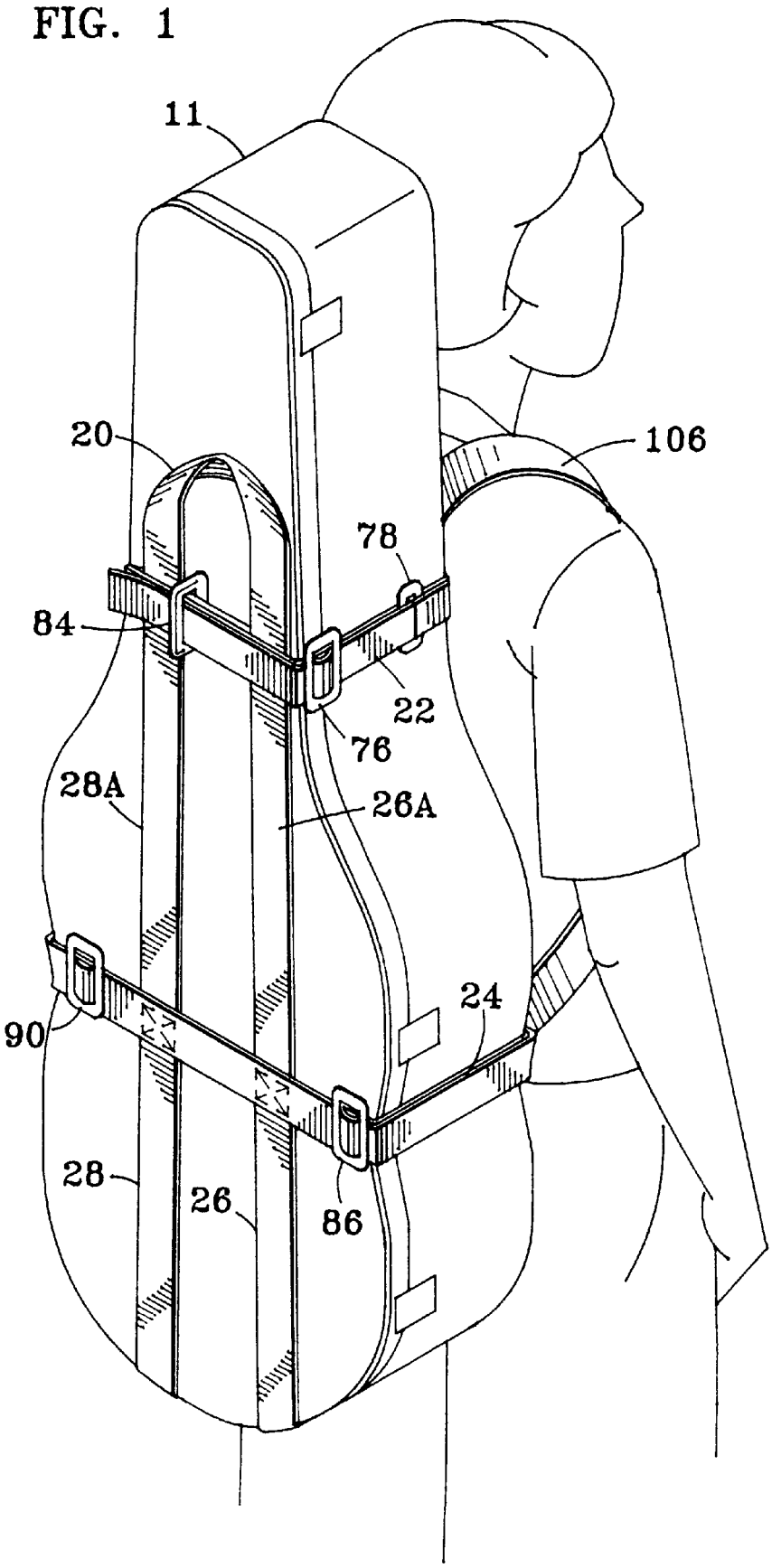
FIG. 1 is a view of the carrying assembly as shown in use on a contoured guitar case and on the back of a person.

While the invention is susceptible to various modifications and alternative forms, specific embodiments thereof are shown by way of example in the drawings and will herein be described in detail. It should be understood, however, that the drawings and description thereto are not intended to limit the invention to the particular forms disclosed, but on the contrary, the invention is to cover all modifications, equivalents, and alternatives falling within the spirit and scope of the present invention as defined by the appended claims.

The present invention discloses an assembly and method thereof for a carrying apparatus, constructed as an adjustable harness with adjustable shoulder straps, that serves to carry a wide variety of size, shape, and style musical instruments and instrument cases, comfortably and easily.

An advantage of the present invention is to provide an assembly which can easily, securely, and comfortably transport a musical instrument by itself or in its case on the back of a wearer. The present invention allows the weight of the case and the instrument to be securely enclosed in a harness and comfortably carried on one's back with a shoulder strap assembly. This enables the wearer to maneuver easily through any circumstance, hands free, without discomfort, for any distance, with an instrument securely fastened, carried like a backpack, and in the protection of a crush-proof case.

Another advantage of the present invention is that the assembly is vastly adjustable to accommodate great variance in the type, size, shape, and style of instrument or instrument case that can be carried.

Another advantage of the present invention is to allow the assembly to be placed on and removed from the back of the wearer, as well as attached to and removed from an instrument or instrument case, quickly and easily.

Figure 2:
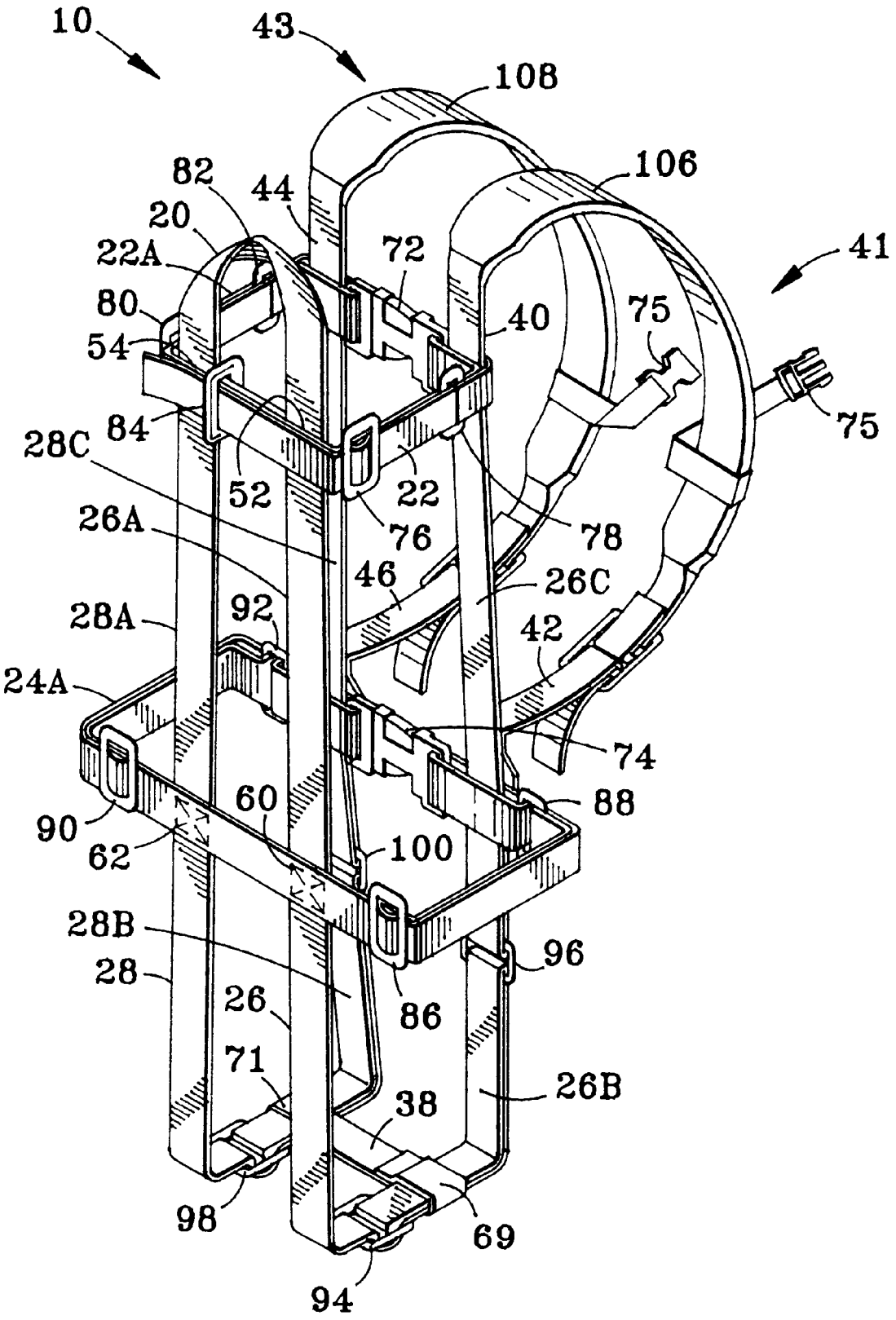
FIG. 2 is a rear perspective view of the carrying assembly.
Figure 3:
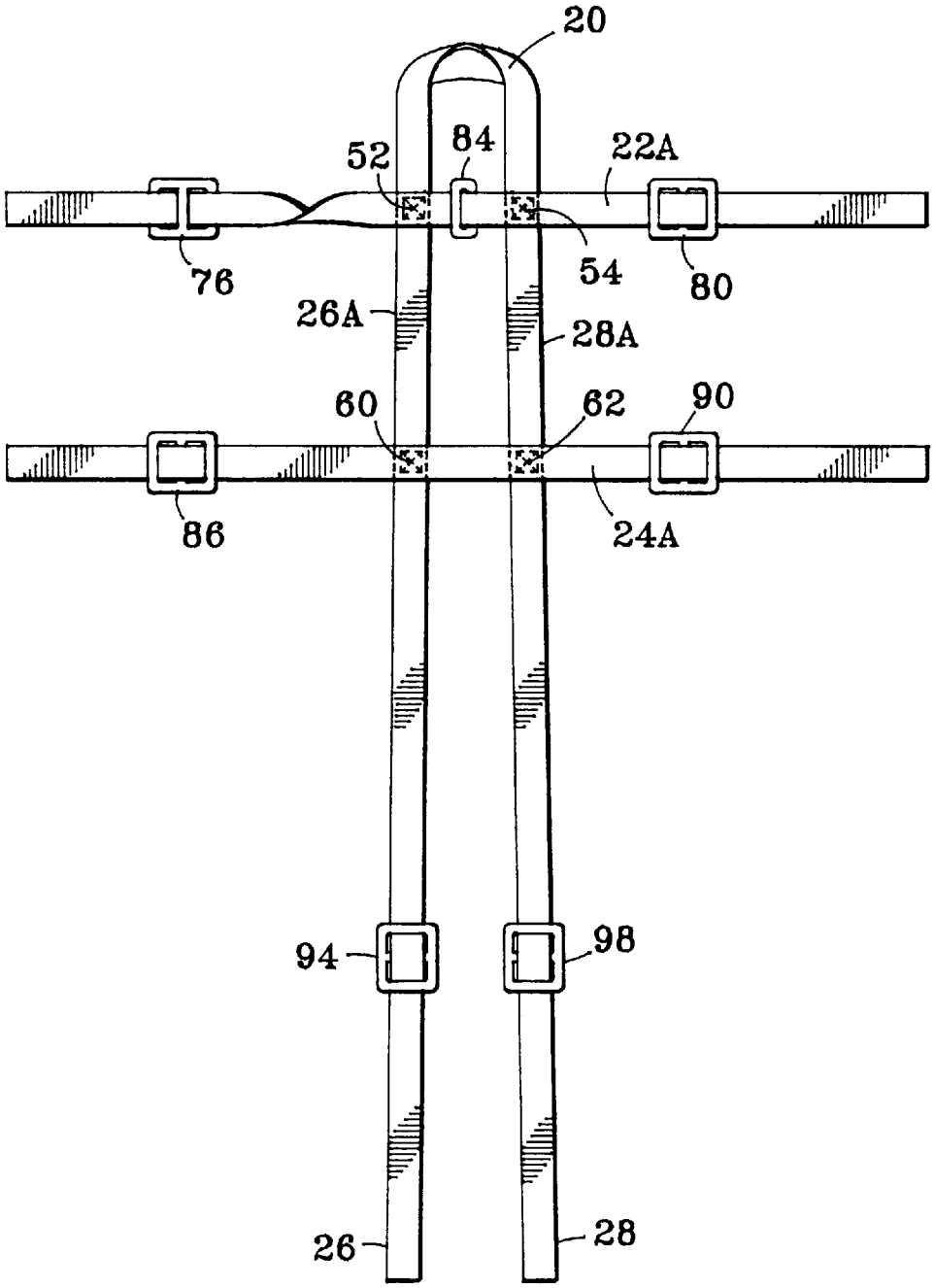
FIG. 3 is a view of the rear piece of the carrying assembly, detached to show this integral component of the invention.
Figure 4:
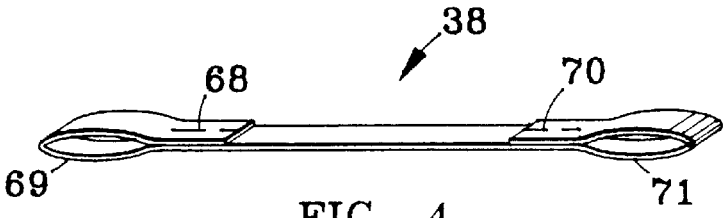
FIG. 4 is a view of the bottom cross piece of the carrying assembly, detached to show this integral component of the invention.
Figure 5:
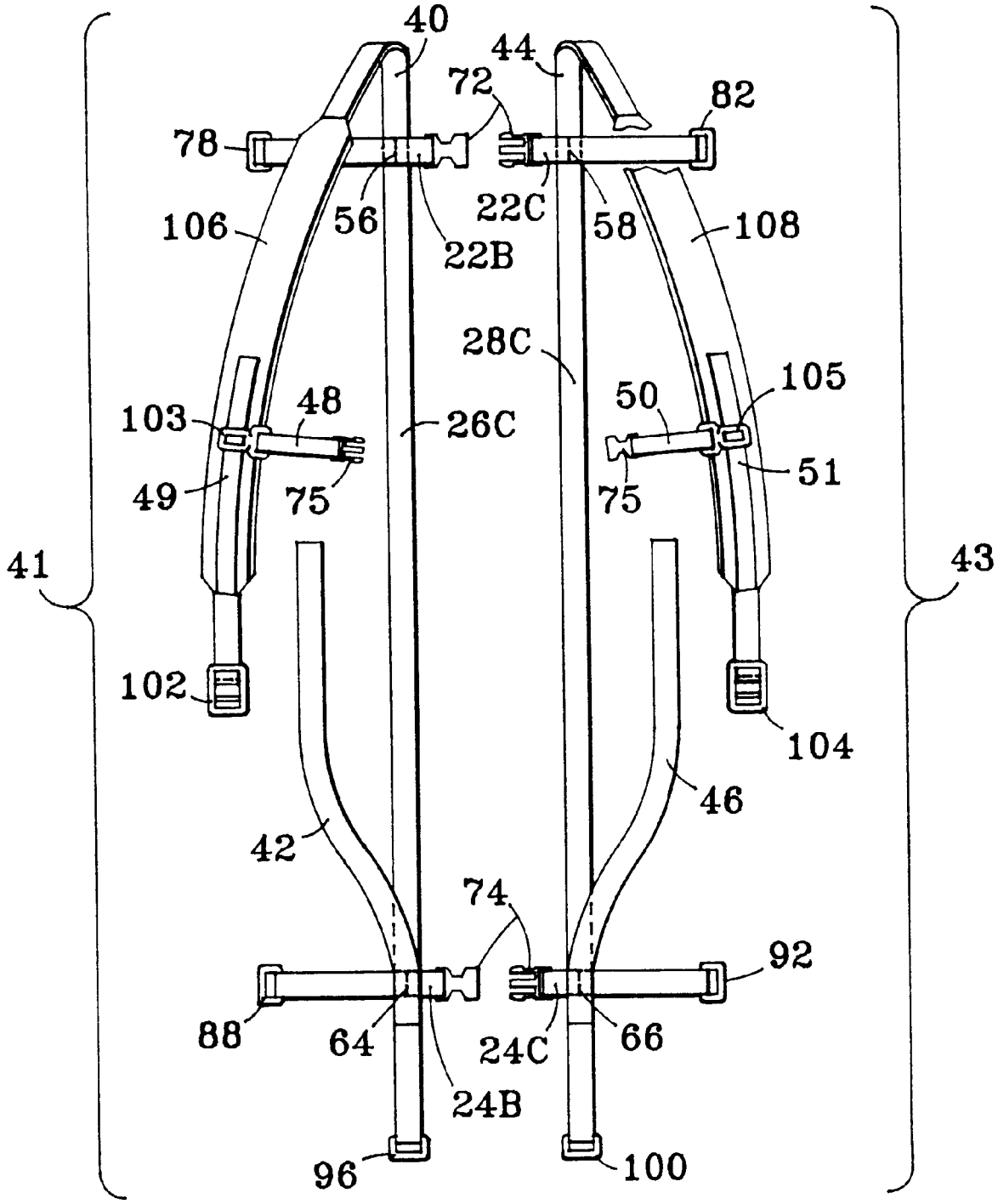
FIG. 5 is a view of the front piece of the carrying assembly, detached to show an integral component of the invention.

Referring now to FIGS. 1–5, the musical instrument carrying assembly 10 is shown in a perspective view in FIG. 2 and shown in FIG. 1 in a view in the shape taken when used on a contoured guitar case 11 and carried on the back of a person. Although a guitar case is being used for example purposes, the carrying assembly 10 may be used on a wide variety of musical instrument cases such as cases used to hold violins, trombones, bassons, etc. Also, the carrying assembly 10 may also be used with just the instrument itself and without an instrument case around it. Finally, the instrument case may be of a rigid type or of a soft, pliable material.

The carrying assembly 10 of the present invention is detachable meaning that it merely encloses an instrument or instrument case and is not necessarily permanently attached to it. Also, the carrying assembly of the present invention is collapsible meaning that when it is not enclosing an instrument or instrument case the carrying assembly may be flattened or compacted.

The carrying assembly 10 is mainly constructed of a plurality of straps, preferably made from a flexible and durable material such as polypropylene or nylon webbing in the preferred embodiment, although many other types of durable strap or banding materials could be employed. These straps form a carrying or harness assembly 10 designed to receive and enclose a musical instrument or musical instrument case. The carrying assembly 10 is widely adjustable to accommodate a wide variety of size, shape, and style instruments and instrument cases. The carrying assembly 10 also includes first adjustable shoulder strap assembly 41 and second adjustable shoulder strap assembly 43 which allow an instrument or instrument case to be securely held, worn, and comfortably carried on one's back like a backpack.

The instrument carrying assembly 10 is comprised of adjustable enclosing straps 22 and 24. The neck and body straps 22 and 24 extend in a transverse direction to the case 11. The first enclosing strap, the neck strap 22, fastens around the upper portion or neck of the case 11. The second enclosing strap, the body strap 24, fastens around the body of the case and, particularly, may fasten at the contoured curve if the instrument and/or case has one. The neck and body straps 22 and 24 are joined by and fixed to a first longitudinal strap 26 and a second longitudinal strap 28. The first and second longitudinal straps 26 and 28 initiate at the back of the neck strap 22 where the fastening points or stitches 52 and 54 are attached to the handle 20. The handle 20 may be in a loop form or some other type of grippable form. The first longitudinal strap 26 is a continuous, integrally formed strap which includes a first back longitudinal strap segment 26A, a first bottom longitudinal strap segment 26B, and a first front longitudinal strap segment 26C. The second longitudinal strap is also a continuous, integrally formed strap which includes a second back longitudinal strap segment 28A, a second bottom longitudinal strap segment 28B, and a second front longitudinal strap segment 26C. Although two longitudinal straps 26 and 28 are shown it is to be understood that more than or less than two longitudinal straps could be used.

The neck strap 22 and body strap 24 are fastened to the first and second longitudinal straps 26 and 28 on the back of the case 11 by a plurality of fastening points or stitches 52, 54, 60, and 62 in the preferred embodiment, although other methods of fastening could be employed. The first and second back longitudinal strap segments 26A and 28A span the distance from the neck strap 22 to the body strap 24. The back longitudinal strap segments 26A and 28A are fastened at stitches 52 and 54 to the neck strap 22 and at the stitches 60 and 62 where they cross the body strap 24. In the preferred embodiment, the distance between the fastening points 60 and 62 may optionally be set slightly greater than the distance between the fastenings 52 and 54. This construction forms a structurally strength-enhancing trapezoidal shape in the case assembly 10 between the first and second longitudinal straps 26 and 28 and the neck and body straps 22 and 24. Although two transverse straps 22 and 24 are shown it is to be understood that more than or less than two transverse straps could be used.

The longitudinal strap segments 26A and 28A span the distance from the fastening points 52 and 54 to the body strap 24 at fastening points 60 and 62. The distance from the body strap 24 at fastening points 60 and 62 around the lower back, bottom and lower front of the case 11 is spanned by the first and second bottom longitudinal strap segments 26B and 28B. The longitudinal strap segments 26A and 28A are integrally connected to the first and second bottom longitudinal strap segments 26B and 28B which wrap beneath the bottom of the case 11, by the fastening points 60 and 62.

The first and second bottom longitudinal strap segments 26B and 28B extend through the first loop end 69 and the second loop end 71 of the bottom strap 38. The bottom strap 38 consists of a segment of strapping with the ends fastened to itself at points 68 and 70 forming the first and second loop ends 69 and 71 on each end which are slightly larger than the width of the longitudinal straps 26 and 28.

After passing through the first and second loop ends 69 and 71 of the bottom strap 38, the first and second bottom longitudinal strap segments 26B and 28B are integrally connected to the first and second front longitudinal strap segments 26C and 28C at the first joining loop or ring 96 and second joining loop or ring 100. The first and second bottom longitudinal strap segments 26B and 28B pass through first joining loop or ring 96 and second joining loop or ring 100. The first and second joining loops 96 and 100 are plastic in the preferred embodiment, but could be metal or almost any strong, durable material and shape.

The ends of bottom longitudinal strap segments 26B and 28B are fixed to first and second sliding length adjusters 94 and 98 after passing through the lower side of the first and second joining loops 96 and 100. In the preferred embodiment, the sliding length adjusters 94 and 98 are three-bar type, sliding, strap-length adjusters, which may or may not be fixed by their middle bar to the end of a strap.

The first and second front longitudinal strap segments 26C and 28C are fixed around the upper side of the first and second joining loops 96 and 100 and then span the distance to the front side of the body strap 24 where they fasten at stitches 64 and 66. The first and second front longitudinal strap segments 26C and 28C continue spanning the distance from the body strap 24 to the neck strap 22 where they fasten to the front of the neck strap 22 at stitches 56 and 58. As on the back side of the case 11, the distance between the fastening points 64 and 66 of the body strap 24 may optionally be set slightly greater than the distance between the fastening points 56 and 58 to the neck strap 22. This forms a structurally strength-enhancing trapezoidal shape in the harness assembly 10 between the longitudinal straps 26 and 28 and the neck and body straps 22 and 24.

According to a feature of the invention, the neck strap 22 may be comprised of segments of strapping material and a combination of joining loop fasteners, sliding length adjusters, and releasable buckle-type fasteners. The first neck strap segment 22A of the neck strap 22 is fixed on the back side of the carrying assembly 10 to the back longitudinal strap segments 26A and 28A at stitches 52 and 54 forming handle 20. This first neck strap segment 22A passes through one side of each of the neck strap joining loop fasteners 78 and 82 and through strap sliding length adjusters 76 and 80. In the preferred embodiment, the ends of this largest segment of the neck strap 22A are not fixed to, but only pass through the neck strap sliding length adjusters 76 and 80. This is so the circumference of the neck strap 22 is most-widely adjustable to accommodate the widest possible variety of instrument or instrument case shapes, styles, and dimensions. In situations where a great deal of strapping must be slid through the neck strap sliding length adjusters 76 and 80 in order to snugly enclose a narrow, small-circumference case, neck strap excess retaining loop 84 is used to secure the excess strapping. A second neck strap segment 22B and a third neck strap segment 22C of the neck strap 22 are fixed to the other side of each of neck strap joining loops 78 and 82. The second and third neck strap segments 22B and 22C form the fastening points 56 and 58 with the longitudinal strap segments 26C and 28C and are fastened, one to each half of a neck strap releasable buckle-type fastener assembly 72. The first neck strap segment 22A may be longer than each of the second and third neck strap segments 22B and 22C. In the embodiment illustrated this releasable buckle-type fastening assembly 72 is a two-part, side-release-style buckle. Each of the two parts of the buckle 72 is fixed on one side to one end of the neck strap 22. One of the parts of the buckle 72 is fixed to the neck strap segment 22B and the other to the neck strap segment 22C. This is to allow the neck strap 22 to be easily placed on, fastened around, and removed from an instrument case 11 while maintaining its circumference adjustments.

According to another feature of the present invention, the body strap 24 may also be comprised of segments of strapping material and a combination of joining loop fasteners, sliding length adjusters, and releasable buckle-type fasteners. The first body strap segment 24A of the body strap 24 is fixed on the back side of the carrying assembly 10 to the longitudinal straps 26 and 28 at fastening points 60 and 62. This first body strap segment 24A passes through one side of each of the body strap joining loops 88 and 92 and through body strap sliding length adjusters 86 and 90. In the preferred embodiment, the ends of this first body strap segment 24A of the body strap 24 are fixed to the body strap sliding length adjusters 86 and 90 after passing through body strap joining loops 88 and 92, unlike the neck strap 22. A second body strap segment 24B and third body strap segment 24C are fixed to the other side of each of the body strap joining loops 88 and 92. These second and third body strap segments 24B and 24C form the fastening points 64 and 66 with the longitudinal strap segments 26C and 28C and are fastened, one to each half of a body strap releasable buckle-type fastener assembly 74. In the preferred embodiment, this releasable buckle-type fastening assembly 74 is a two-part, side-release-style buckle. Each of the two parts of the buckle 74 is fixed on one side to the one end of the body strap 24. One of the parts of the buckle 74 is fixed to the body strap segment 24B and the other to the body strap segment 24C. This is to allow the body strap 24 to be easily placed on, fastened around, and removed from the instrument case 11 while maintaining its circumference adjustments.

The present invention also includes a first shoulder strap assembly 41 and a second shoulder strap assembly 43. The first shoulder strap assembly 41 includes a first upper shoulder strap segment 40 and a first lower shoulder strap segment 42. The second shoulder strap assembly 43 includes a second upper shoulder strap segment 44 and a second lower shoulder strap segment 46. The first and second lower shoulder strap segments 42 and 46 are connected to the longitudinal straps 26 and 28 near stitches 64 and 66 at one end and to the first and second shoulder straps by fixed length adjusters 102 and 104 at the other end. The shoulder strap assemblies 41 and 43 may be made of elongated, flexible, padded, shoulder straps and the upper and lower shoulder strap segments may be adjustably joined. (Optionally, the upper and lower shoulder strap segments may be integrally formed into a continuous piece with no fixed length adjusters located in between). The upper shoulder strap segments 40 and 44 may have padded lengths 106 and 108 for maximum carrying comfort when worn on the back. Additionally for carrying comfort, the upper shoulder strap segments may have first and second chest cross strap segments 48 and 50. These are fixed on one end to the first and second upper shoulder strap segments 40 and 44 and the other ends attached to a length-adjusting, two-part, side-release-style buckle assembly 75. The upper shoulder strap segment ends of the chest cross strap segments 48 and 50 are attached to the upper shoulder strap segments 40 and 44 in a manner that allows the chest cross strap segments 48 and 50 to be adjustable to set on the chest of the wearer at various heights to be optimally comfortable for all body type and build wearers. This longitudinal adjustment along the upper shoulder strap segments 40 and 44 is made by moving longitudinal placement sliding length adjusters 103 and 105 longitudinally along first cross chest strap longitudinal adjustment strap 49 and second cross chest strap longitudinal adjustment strap 51. The fastened chest cross strap segments 48 and 50 hold the shoulder straps comfortably in position and help distribute the weight of the instrument case evenly across the shoulder strap assemblies 41 and 43.

The upper shoulder strap segments 40 and 44 pass over the shoulders of the wearer and have at their ends fixed, length-adjusting, releasable fasteners 102 and 104. These fixed releasable fasteners 102 and 104 adjustably join the bottom ends of the first and second upper shoulder strap segments 40 and 44 with the top ends of the first and second lower shoulder strap segments 42 and 46, which pass under the arms of the wearer. These adjustably-joined upper and lower shoulder strap segments form adjustable-circumference, shoulder strap, loop assemblies. As stated above, the bottom ends of the first and second lower shoulder strap segments 42 and 46 are fastened to the carrying assembly 10 near the fastening points 64 and 66 joining the pair of longitudinal straps 26 and 28 and the body strap 24. The upper shoulder strap segments 40 and 44 are fastened to the carrying assembly 10 near the fastening points 56 and 58 joining the pair of longitudinal straps 26 and 28 and the neck strap 22.

Operation of the Invention

The following is a preferred example of a method of operation of the invention being used with a musical instrument case. The carrying assembly 10 for musical instrument cases may be placed on and adjusted to a case 11 and a wearer in the following manner. The neck strap side-release buckle assembly 72 and the body strap side-release buckle assembly 74 are released with the two components separated. The chest cross strap side-release buckle 75 is also released and separated. The entire carrying assembly 10 is placed flat, shoulder straps up, and open with each shoulder strap assembly 41 and 43 set off to one side. An instrument case is then set on the longitudinal strap 26 and 28 so that the top, neck, or headstock of the instrument sets toward the handle 20, with the approximate middle or contoured curve (if one exists) of the instrument case set on the body strap 24. The neck strap side-release buckle assembly 72 is then closed around the upper or neck portion of the case 11 and the circumference is adjusted so that the neck strap 22 fits snugly using the neck strap sliding length strap adjusters 76 and 80. As previously stated, the ends of the first neck strap segment 22A are not fixed to the middle bars of neck strap sliding length adjusters 76 and 80 to allow the circumference of the neck strap 22 to be most-widely adjustable (although they could be fixed). The neck strap circumference is adjusted by lengthening or shortening the amount of strapping material and therefore the distance between the neck strap sliding length adjusters 76 and 80 and neck strap joining loops 78 and 82. This is accomplished by holding the end of the first neck strap segment 22A and drawing the strapping material through the neck strap sliding length adjuster 76 and the neck strap joining loop 78. The excess ends of the first neck strap segment 22A drawn through the neck strap sliding length adjusters 76 and 80 may be tucked in the excess retaining loop 84 to keep them secured and out of the way. Symmetrical adjustments are made between the adjusters 76 and 80 and neck strap joining loops 78 and 82 so that the neck strap 22 is snug and positions the pair of longitudinal straps 26 and 28 so that they are centered on the back and the front of the case 11.

The body strap side-release buckle 74 may then be closed around the case (for example, in the middle or contour of the case if one exists) and the circumference is adjusted so that the body strap 24 fits snugly by using the body strap sliding length strap adjusters 86 and 90. As previously stated, the ends of the first body strap segment 24A are fixed to the middle bars of body strap sliding length adjusters 86 and 90 (although they could just pass through and not be fixed as demonstrated above in the circumference adjustments for the neck strap 22). The body strap circumference is adjusted by lengthening or shortening the distance between the fastening points 60 and 62, where the body strap 24 and the pair of longitudinal straps 26 and 28 are fixed, and the body strap joining loops 88 and 92. This is accomplished by moving body strap sliding length adjusters 86 and 90 along the first body strap segment 24A and drawing the strapping material through the body strap joining loops 88 and 92. Moving the body strap sliding length adjusters 86 and 90 towards the fastening points 60 and 62 shortens the distance between them and the body strap joining loops 88 and 92, therefore decreasing the circumference of the body strap 24. Conversely, moving the body strap sliding length adjusters 86 and 90 towards the body strap joining loops 88 and 92 lengthens the distance between then and the fastening points 60 and 62, therefore increasing the circumference of the body strap 24. Symmetrical adjustments are made between the adjusters 86 and 90 and body strap joining loops 88 and 92 so that the body strap 24 is snug and positions the pair of longitudinal straps 26 and 28, so that they are centered the on back side and front side of the case.

The bottom strap 38 is placed to line up with the bottom of the case 11 to prevent the longitudinal straps 26 and 28 from separating and the instrument case 11 from falling through the longitudinal straps 26 and 28.

The length of longitudinal straps 26 and 28 is then adjusted to fit snugly around the bottom of the case 11. These longitudinal strap length adjustments allow the carrying assembly 10 to accommodate a wide variety of case depths and case lengths. As stated above, the ends of bottom longitudinal strap segments 26B and 28B are fixed to the middle bar of the first and second longitudinal strap sliding-length adjusters 94 and 98 after passing through the lower side of the first and second longitudinal strap joining loops 96 and 100. The length of longitudinal straps 26 and 28 is adjusted by moving the first and second longitudinal strap sliding-length adjusters 94 and 98 along the longitudinal strap segments 26B and 28B and drawing the strapping material through the longitudinal strap joining loops 96 and 100. Moving the longitudinal strap sliding length adjusters 94 and 98 towards the fastening points 60 and 62 shortens the distance between them and the longitudinal strap joining loops 96 and 100, therefore decreasing the length of the longitudinal straps 26 and 28. Conversely, moving the longitudinal strap sliding length adjusters 94 and 98 towards the longitudinal strap joining loops 96 and 100 lengthens the distance between them and the fastening points 60 and 62, therefore increasing the length of the longitudinal straps 26 and 28

Each shoulder strap is then placed on the wearer and the desired comfortable length independently adjusted by pulling or releasing the lower shoulder strap segments 42 and 46 through the first and second fixed length adjusters 102 and 104 on the ends of the upper shoulder strap segments 40 and 44.

Lastly, the cross chest strap buckle assembly 75 is fastened and the strap length and longitudinal placement adjusted for maximum comfort. The cross chest strap length is adjusted by drawing the cross chest strap segment 48 through the length adjuster incorporated in one side of the cross chest strap buckle assembly 75. The cross chest strap longitudinal placement is adjusted by moving the cross chest strap longitudinal placement sliding length adjusters 103 and 105 longitudinally along first cross chest strap longitudinal adjustment strap 49 and second cross chest strap longitudinal adjustment strap 51.

The enclosed musical instrument case 11 may then be comfortably carried like a backpack by the wearer. The assembly can be removed from the case simply by releasing the two side-release buckle assemblies 72 and 74 and later placed back on the case 11 by placing the straps around the case 11 and closing the same two buckle assemblies.

From the forgoing description and references to the accompanying figures it can be seen that the carrying assembly 10 for musical instruments and instrument cases comprises a harness to receive, enclose, and securely fasten around a musical instrument or instrument case and can be adjustably fitted to a wide variety of size, shape, and style instruments and instrument cases. Additionally, shoulder strap assemblies enable one to comfortably carry the harness-enclosed instrument or instrument case on the back like a backpack. It can also be seen that the carrying assembly for musical instrument cases is designed to enable instruments to be safely and easily carried. The present invention is simple to use and adjust, can be quickly placed on and removed from both a case and a wearer, and is light-weight and compactable. The present invention is also a convenient and innovative way for all musicians to transport their instruments.

While there has been shown and described herein what is presently considered to be the preferred embodiment of this invention, it will be apparent to those skilled in such art that various changes and modifications may be made without departing from the broader aspects of this invention. It is anticipated that numerous modifications or alterations can be made therein without departing from the spirit and scope of the invention as defined by the claims appended hereto. For example; different types of strapping material could be utilized; other types or combinations of fastening connections could be employed to fasten the strap segments, straps, assemblies, and components together, or to the fasten the strap segments to the various joiners, connectors, and length adjusters (i.e. sewing, rivets, glue, staples, etc.); and a wide variety of joiners, connectors, fasteners, length adjusters, release mechanisms, buckle assemblies, loops, and pads manufactured of wide variety of materials and shapes could be employed. It is therefore, aimed in the appended claims to cover all such changes and modifications as fall within the true spirit and scope of this invention. Accordingly, the scope of the invention should be determined not by the preferred embodiment illustrated, but by the appended claims and their legal equivalents. Therefore, regardless of slight variations or modifications or arrangements of components, it is intended that the following claims be interpreted to embrace all such modifications and changes provided the intended function is substantially performed in substantially the same way to achieve substantially the same result.

I claim:

1. A detachable carrying assembly for carrying a rigid musical instrument case comprising:

first and second longitudinal straps;

first and second transverse straps connected to said first and second longitudinal straps;

first and second shoulder strap assemblies attached to both the first and second transverse straps and the first and second longitudinal straps;

a handle attached to the first and second longitudinal straps;

a bottom strap attached to the first and second longitudinal straps; and wherein the longitudinal straps, transverse straps, and shoulder strap assemblies are adjustable through the use of a plurality of fasteners.

2. The carrying assembly of claim 1, wherein the handle is U-shaped.

3. The carrying assembly of claim 1, wherein the carrying assembly is collapsible.

4. The carrying assembly of claim 1, wherein the fasteners on the transverse straps are positioned on the side of the carrying assembly toward the wearer.

* * * * *